US008615829B2

(12) United States Patent
Kenalty et al.

(10) Patent No.: US 8,615,829 B2
(45) Date of Patent: Dec. 31, 2013

(54) SUBWAY EVACUATION MATTRESS AND METHOD OF MANUFACTURE

(75) Inventors: Christopher Kenalty, Toronto (CA); Miriam Gordon, Mississauga (CA)

(73) Assignee: Evacusled Inc. (CA)

( * ) Notice: Subject to any disclaimer, the term of this patent is extended or adjusted under 35 U.S.C. 154(b) by 0 days.

(21) Appl. No.: 12/968,840

(22) Filed: Dec. 15, 2010

(65) Prior Publication Data

US 2012/0151679 A1 Jun. 21, 2012

(51) Int. Cl.
*A47B 1/00* (2006.01)

(52) U.S. Cl.
USPC ..... 5/628; 5/625; 5/626; 5/627; 5/629; 5/740; 5/655.9

(58) Field of Classification Search
USPC ..... 5/625–629, 740, 655.9; 128/869, 870; 602/32–36
See application file for complete search history.

(56) References Cited

U.S. PATENT DOCUMENTS

| | | | | | |
|---|---|---|---|---|---|
| 3,158,875 | A | | 12/1964 | Fletcher | |
| 4,024,861 | A | * | 5/1977 | Vincent | 602/19 |
| 4,034,748 | A | * | 7/1977 | Winner | 602/19 |
| 4,059,282 | A | * | 11/1977 | Prickett | 280/47.331 |
| 4,124,908 | A | * | 11/1978 | Burns et al. | 5/628 |
| 4,736,474 | A | | 4/1988 | Moran et al. | |
| 4,793,008 | A | | 12/1988 | Johansson | |
| 5,044,031 | A | * | 9/1991 | Sherwood et al. | 2/69.5 |
| 5,249,321 | A | | 10/1993 | Graf | |
| 5,568,662 | A | * | 10/1996 | Gougelet | 5/625 |
| 5,577,281 | A | * | 11/1996 | Mital et al. | 5/625 |
| 6,055,988 | A | * | 5/2000 | Perisho | 128/869 |
| 6,371,119 | B1 | * | 4/2002 | Zadini et al. | 128/845 |
| 6,772,764 | B2 | * | 8/2004 | Chapman | 128/870 |
| 6,826,800 | B2 | * | 12/2004 | Kao | 16/31 R |
| 6,845,533 | B1 | * | 1/2005 | Tulette | 5/626 |
| 6,848,134 | B1 | * | 2/2005 | Schenck | 5/625 |
| 6,871,368 | B2 | * | 3/2005 | Calkin | 5/628 |
| 6,966,087 | B2 | * | 11/2005 | Robinette | 5/625 |
| 7,065,814 | B2 | * | 6/2006 | Rutkowski | 5/655 |
| 7,422,220 | B2 | * | 9/2008 | Walkingshaw et al. | 280/18 |
| 7,437,789 | B2 | * | 10/2008 | Thompson | 5/655.3 |
| 7,699,324 | B2 | * | 4/2010 | Walkingshaw et al. | 280/18.1 |
| 7,774,877 | B2 | | 8/2010 | Kenalty et al. | |
| 8,006,334 | B2 | * | 8/2011 | Kenalty et al. | 5/626 |
| 8,122,543 | B2 | * | 2/2012 | Kenalty et al. | 5/626 |
| 2005/0055768 | A1 | * | 3/2005 | Assink | 5/81.1 R |
| 2006/0107456 | A1 | * | 5/2006 | Joseph | 5/2.1 |
| 2006/0213011 | A1 | * | 9/2006 | McLoughlin et al. | 5/628 |

(Continued)

OTHER PUBLICATIONS

Transmittal; International Search Report; and the Written Opinion of the International Searching Authority for International Application No. PCT/IB2011/003057 with mailing date of May 18, 2012.

*Primary Examiner* — Robert G Santos
*Assistant Examiner* — David E Sosnowski
(74) *Attorney, Agent, or Firm* — Katten Muchin Rosenman LLP

(57) ABSTRACT

An economical emergency evacuation mattress for persons in areas with limited access, such as subways and high-rises, provides a warm and secure cocoon for the patient, allows easy transport over any type of surface (e.g., up and down stairs), provides proper support for all of the patient's body, allows the patient to feel a high degree of comfort in what is otherwise a very stressful situation, and provides securing means (e.g., straps) to firmly hold the patient in place during transit.

12 Claims, 11 Drawing Sheets

(56) References Cited

U.S. PATENT DOCUMENTS

| | | | | |
|---|---|---|---|---|
| 2007/0056096 | A1* | 3/2007 | Assink | 5/81.1 HS |
| 2007/0136950 | A1* | 6/2007 | Zuercher | 5/627 |
| 2007/0278754 | A1 | 12/2007 | Walkingshaw et al. | |
| 2008/0301876 | A1* | 12/2008 | Kenalty et al. | 5/620 |
| 2009/0000027 | A1* | 1/2009 | Jarrett, III | 5/86.1 |
| 2009/0038076 | A1* | 2/2009 | Giduck | 5/627 |
| 2009/0288255 | A1* | 11/2009 | Sakurai et al. | 5/625 |
| 2009/0313759 | A1* | 12/2009 | Wong | 5/627 |
| 2010/0005593 | A1* | 1/2010 | Bowling et al. | 5/627 |
| 2010/0011506 | A1* | 1/2010 | Jensen et al. | 5/627 |
| 2010/0199435 | A1* | 8/2010 | Jensen et al. | 5/628 |
| 2010/0251479 | A1 | 10/2010 | Kenalty et al. | |
| 2010/0299836 | A1* | 12/2010 | Tanaka et al. | 5/626 |
| 2010/0299837 | A1* | 12/2010 | Yandle | 5/627 |
| 2011/0099717 | A1* | 5/2011 | Windauer | 5/627 |
| 2011/0177733 | A1* | 7/2011 | Grimes | 441/80 |
| 2011/0185504 | A1 | 8/2011 | Kenalty et al. | |
| 2011/0214237 | A1* | 9/2011 | Boudreau et al. | 5/627 |
| 2011/0220695 | A1* | 9/2011 | Saunders et al. | 224/158 |
| 2011/0271450 | A1* | 11/2011 | Johnson et al. | 5/626 |
| 2012/0053423 | A1 | 3/2012 | Kenalty et al. | |
| 2012/0053424 | A1* | 3/2012 | Kenalty et al. | 600/300 |

* cited by examiner

SUBWAY EVACUATION MATTRESS AND METHOD OF MANUFACTURE

TECHNICAL FIELD

The present invention relates to a mattress for rapid evacuation of casualties during emergency and non-emergency situations. More particularly, the invention relates to such a compact mattress which is capable of evacuating an individual where stairs or obstacles are involved, including, for example, a subway station or a high-rise building, and to a method for the manufacture of such a mattress.

BACKGROUND INFORMATION

In emergencies, transporting an injured person is a difficult endeavor, particularly when assistance is limited and the injured person must be transported up or down stairs. Not only is it more difficult for people to move an injured person up or down stairs, but, depending upon the injuries, the stairs may also cause additional damage to the injured person, as may be the case with spinal injuries.

Unfortunately, the world must always be prepared for terrorist attacks and other catastrophes. Recent incidents have affected metropolitan transit systems, such as the subway. For example, on Mar. 20, 1995, members of Aum Shinrikyo (former name of a group now known as Aleph) performed an act of domestic terrorism on the Tokyo subway. The terrorists released sarin, a chemical weapon of mass destruction, on several lines of the Tokyo Metro, killing thirteen people, severely injuring fifty, and causing temporary vision problems for nearly a thousand others. In another attack, on Jun. 11, 1996, a bomb was detonated in the Moscow Metro, killing four people and injuring twelve.

Half a decade later, a string of attacks on subway stations was executed worldwide. On Feb. 5, 2001, another bomb exploded in one of Moscow's busiest underground railway stations during rush hour, injuring approximately a dozen people and causing minor damage. On Feb. 18, 2003, an arsonist set fire to a subway train in Daegu, South Korea, killing nearly 200 and injuring at least 150 more. On Feb. 6, 2004, a powerful explosion, apparently set off by a suicide bomber, ripped through an underground train in Moscow during the morning rush hour, killing at least 39 people and injuring more than 100.

On Mar. 11, 2004, Al Qaeda-linked Islamic militants were responsible for train bombings in Madrid that killed 191 people and wounded 1,800 others. On Jul. 7, 2005, four militants detonated four bombs in London's Underground in protest of Britain's support for the Iraq war, killing 52 people on a network that carries more than three million commuters daily. In late 2009, American authorities foiled an attempt by Afghan-American Najibullah Zazi to bomb the New York City subway system shortly after the 2009 anniversary of the Sep. 11, 2001, terrorist attacks. Most recently, on Mar. 29, 2010, two bombings in the Moscow subway killed at least 37 people.

It is an unfortunate trend that terrorists are targeting subway systems. Subway systems are not only crowded, but they are compact spaces that amplify the carnage caused by even a moderately sized bomb. In fact, shortly after the 2010 Moscow attacks, Will Geddes, Managing Director of International Corporate Protection, remarked "[s]ubway attacks are ideal for a terrorist," adding "[t]hey are bringing the whole city to a halt and they not only create the disruption on that particular day, but they create a greater residue of fear, which is their main aim . . . . They are getting their message across and causing disruption."

The same factors that make a subway an ideal target for terrorists make a subway an even more difficult rescue mission. Because subways are below ground, they inherently have limited access to the outside world, and those few access points they have are typically narrow and obstructed with stairs, turnstiles, and possibly debris. A traditional gurney will have a difficult time navigating a subway system. Similarly, a traditional gurney is cumbersome and cannot easily traverse a flight of stairs. Typically, carrying the gurney and injured person requires two people (e.g., medical response personnel).

Although this method may work in limited circumstances, such as when a single person is injured or in open, spacious areas, it would be nearly impossible to timely and effectively assist the victims of a subway terrorist attack during an emergency situation. To overcome this medical response deficiency, there is a need for a device which is (i) compact and light; (ii) capable of transporting a person up or down stairs; and (iii) preferably requires only a single caregiver to transport an injured person. Such a device could, in operation, resemble that of a sled, which can safely and quickly drag a patient to safety to receive medical treatment but be compacted and stowed in subways, stairwells, and high-rise buildings, or be easily transported to such sites.

While many sled-type patient evacuation devices are known (such as the evacuation sled disclosed in U.S. Patent Publication No. 2007/0278754 to Walkingshaw), these sleds require several caregivers to transfer the patient onto the sled for evacuation. The sleds are then dragged through the evacuation site, down numerous flights of stairs, and then to an evacuation center where the patient waits (often for hours) for transportation to a hospital, where the patient must be removed from the sled and placed in a bed (again requiring several caregivers). This leads to problems such as contusions to the patient from being bounced down steps, patient hypothermia, and the necessity for many caregivers to perform the multiple patient-transfer steps.

Other known structures for evacuating non-ambulatory persons include boards or mats to support the patient. For example, U.S. Pat. No. 4,793,008 to Johansson discloses rigid mats with straps, placed respectively beneath the patient's chest and thighs. A relatively complicated Rescue Transportation Mattress is disclosed in U.S. Pat. No. 4,736,474, to Moran, et al., wherein an inflatable support member and crossed straps are used to secure the person being transported. Again, such solutions do little for a quick, safe, and warm evacuation of a patient during an emergency.

There are numerous other patents and patent applications employing rigid or semi-rigid supports and belts or straps to secure the person being transported to the support. One apparent disadvantage to this use of straps or belts is that they could exert undue or excessive pressure on particular locations on the bodies of some evacuees, such as in the case of recent surgery patients. Another disadvantage that is not obvious is that the use of many straps, harnesses, buckles, etc., delays the process of readying the patient for rescue and evacuation when timely removal is vital. More importantly, while they may be able to travel down stairs, none of prior art is capable of safely evacuating a person up a flight of stairs.

Thus, what is needed is an economical emergency mattress capable of being used to evacuate persons from areas with limited access, such as subways and high-rises, that is preferably capable of operation by a single caregiver, provides a warm and secure cocoon for the patient, allows easy transport over any type of surface (e.g., up and down stairs), provides proper support for all of the patient's body, allows the patient to feel a high degree of comfort in what is otherwise a very stressful situation, and provides securing means (e.g., straps) to firmly hold the patient in place during transit.

SUMMARY

The present disclosure endeavors to provide an economical evacuation mattress that addresses the problems of the prior art.

According to a first aspect of the present invention, a mattress capable of traversing stairs comprises: one or more outer skin panels; one or more spinal boards disposed within the one or more outer skin panels; two or more adjustable securing straps coupled to an outer surface of the one or more outer skin panels; a padding layer disposed within the one or more outer skin panels and configured to provide cushioning to the one or more spinal boards; and one or more transport straps coupled to the outer surface of the one or more outer skin panels. The two or more securing straps may include: (i) a pair of shoulder straps; (ii) a chest strap; (iii) a hip strap; (iv) a groin strap; and/or (v) leg straps.

In certain embodiments, the mattress may include one or more of the following: one or more side-handles; triage tags; and/or one or more casters mounted on each of the one or more spinal boards. The one or more outer skin panels may include, for example, an upper skin panel, a lower skin panel and, in certain embodiments, an intermediate side-wall skin. The lower skin panel may further include a second material having a durability greater than the lower skin panel attached thereon. Similarly, the lower skin panel may be constructed entirely from a second material having a durability greater than upper skin panel.

According to a second aspect of the present invention, a method of manufacturing an evacuation mattress capable of traversing stairs comprises the steps of: attaching one or more spinal boards to one or more outer skin panels; mounting two or more adjustable securing straps to the one or more outer skin panels; installing one or more transport straps on the one or more outer skin panels; and installing a padding layer over the one or more spinal boards. The two or more securing straps may include: (i) a pair of shoulder straps; (ii) a chest strap; (iii) a hip strap; (iv) a groin strap; and/or (v) leg straps.

In certain embodiments, the mattress may include one or more of the following: one or more side-handles; triage tags; and/or one or more casters mounted on each of the one or more spinal boards. The one or more outer skin panels may include, for example, an upper skin panel, a lower skin panel and, in certain embodiments, an intermediate side-wall skin. The lower skin panel may further include a second material having a durability greater than the lower skin panel attached thereon. Similarly, the lower skin panel may be constructed entirely from a second material having a durability greater than upper skin panel.

According to a third aspect of the present invention, an evacuation device capable of traversing stairs comprising: an upper skin panel; a lower skin panel have a second material with a durability greater than lower skin panel attached thereon; one or more spinal boards attached to the lower skin panel, each spinal board having one or more casters; two or more adjustable securing straps; a padding layer located between the one or more spinal boards and the upper skin panel; one or more adjustable shoulder straps; one or more adjustable chest straps; and one or more adjustable hip straps having an adjustable groin strap attached thereto.

DETAILED DESCRIPTION OF THE PRESENTLY PREFERRED EXEMPLARY EMBODIMENTS

A preferred embodiment of the present invention will be described hereinbelow with reference to the accompanying drawings. In the following description, well-known functions or constructions are not described in detail since they may obscure the invention in unnecessary detail.

Figure 1A:
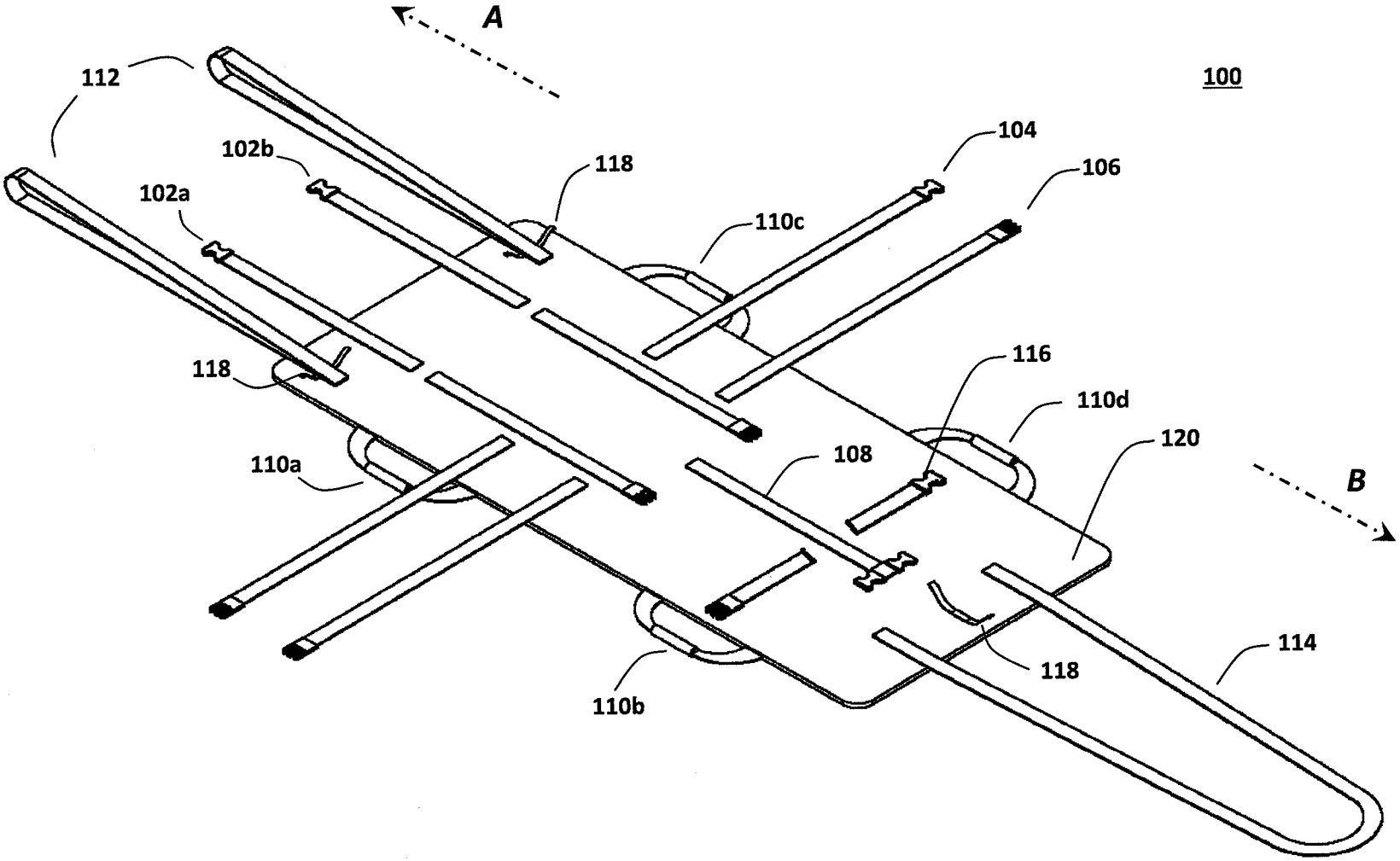
FIG. 1*a* is a top perspective view of the topside of a mattress according to a first embodiment of the present invention.

FIG. 1*a* is a top plan view of the topside of a mattress 100. The mattress of the present embodiment is approximately 35.5×80×1.5 inches, but may be larger or smaller depending on the size of the individuals to be carried. For example, in certain circumstances (e.g., bariatric evacuees), the mattress may be substantially wider e.g., 40, 45, 50, or 60 inches), and perhaps thicker as well (e.g., 2, 2.5, 3, or 4 inches) in order to accommodate a larger evacuee, or more-severe evacuation environments. The construction of the preferred embodiment is light-weight, preferably less than 25 pounds, more preferably less that 20 pounds, most preferable 18 pounds, providing an easy and convenient way to quickly get great numbers of evacuation mattresses to patients The outer skin of the mattress (e.g., upper skin panel 120, lower skin panel 206, and any intermediate side-wall skin) is preferably constructed from a material that meets infection control measures but may also contain microclimate features. The upper skin panel 120 and lower skin panel 206 may be zipped together and secured with a flap to form a continuous skin or, rather than using a zipper, fused together (e.g., thermally, with stitches, with epoxy, etc.). In another embodiment, the skin may also include an intermediate side-wall skin between the upper and lower skin panels where the intermediate side-wall is attached to the upper and lower skin panels using, for example, a zipper or permanently bonded together (e.g., thermally fused, stitched, epoxied, etc.). In a preferred embodiment, the skin panels may be constructed from SoffTICK Standard Institutional Fabric Ultra 53-14, available from Vintex Inc. at www.vintex.com. Ultra 53-14 is advantageous because it is soft, flame retardant, durable, resistant to bacteria/fungal growth, self-deodorizing, hypoallergenic, non-irritating, and foam compatible. Alternative suitable materials may include, for example, ballistic nylon and/or cordura nylon.

An alternative solution to maintaining an anti-fungal and anti-bacterial mattress surface may be to coat the mattress skin panels and/or straps with spray-on liquid glass (also referred to as "$SiO_2$ ultra-thin layering"). Spray-on liquid glass is transparent, non-toxic, and can protect virtually any surface against almost any damage from hazards such as water, UV radiation, dirt, heat, and bacterial infections. Liquid glass coating is also flexible and breathable, making it suitable for use on both traditional mattresses and evacuation mattresses (e.g., the mattress).

The mattress 100 utilizes a number of securing straps to ensure that the person being transported is secure, thus restricting too much shifting. In fact, once strapped in, the patient may be vertically transported without shifting off the mattress. Each securing strap is preferably adjustable in length to accommodate both larger and smaller people and generally comprises two lengths of strap material (e.g., nylon, polypropylene, canvas, etc., similar to well-know auto and aircraft seat and/or safety belts) coupled end-to-end with an adjustable/detachable connections (e.g., a traditional buckle, side-release interlocking buckle, cam lock buckle, etc.). The strap material should also meet infection control measures and, in certain embodiments, may be padded to provide additional comfort to the patient and/or medical personnel.

The distal ends of each securing strap may be permanently attached to a point on the mattress using strap stitching techniques, however they also may be melted, glued, and/or fused with the mattress or mattress material by way of one or more of the skin, the spinal boards, the padding, or other reinforcing structure interior or exterior of the skin. In certain embodiments, the securing strap may be detachably secured to the mattress (e.g., using buckles, snaps, buttons, hooks and loops, etc.). A detachable securing means may be beneficial in situations where the straps have worn out or need to be replaced with a different version or size, or where the straps need to be re-located, for example, to pull from the other end (or side) of the mattress. Furthermore, the lengths of the various securing straps in the figures are merely for illustrative purposes and may or may not be drawn to scale. Preferably, pull straps 112 are each 42-84 inches in length, or 84 inches if one-piece or connected together at the distal ends. Preferably, pull strap 114 is 56-112 inches in length, or 112 inches if one-piece or connected together at the distal ends.

Figure 1B:
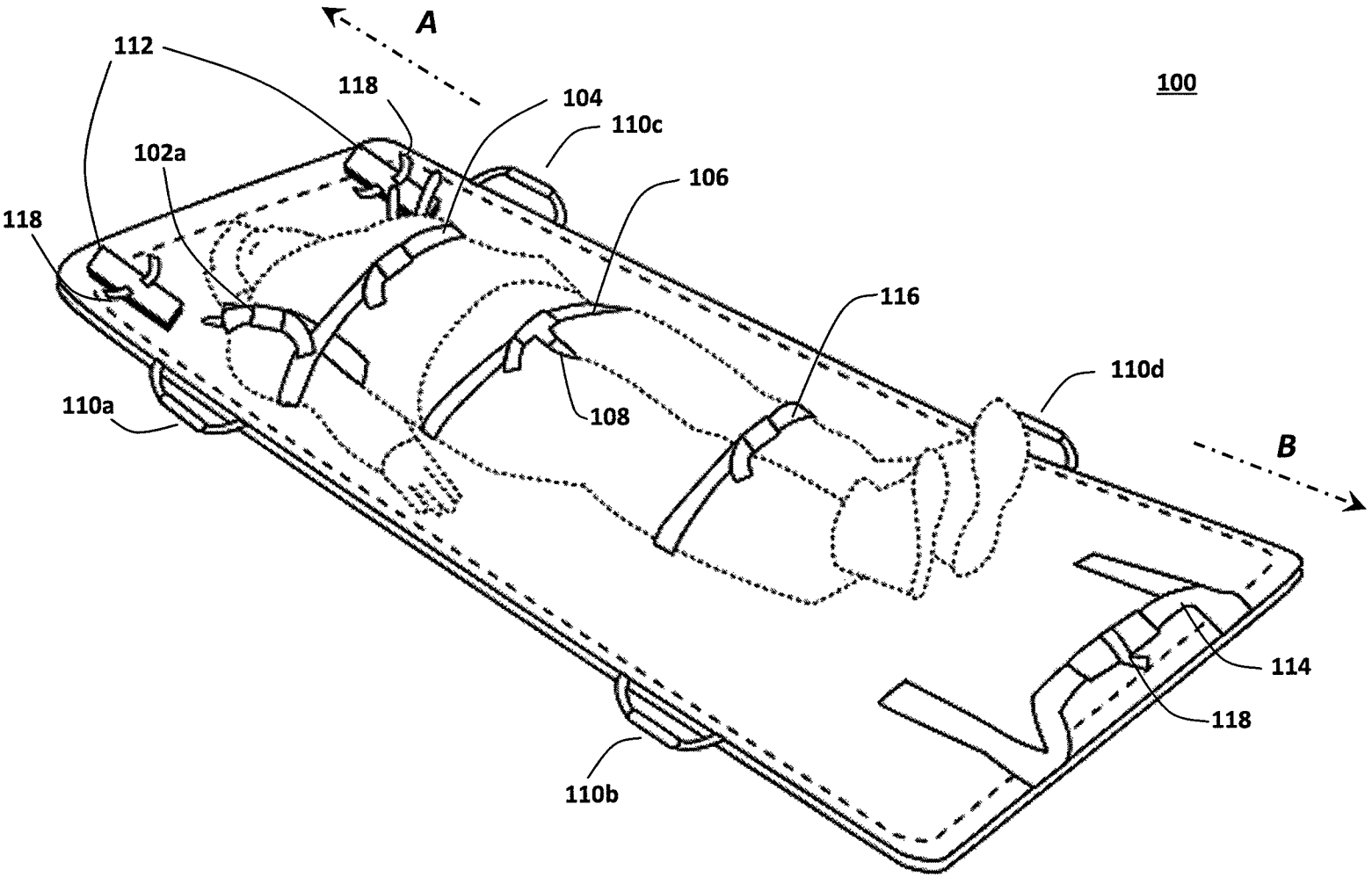
FIG. 1*b* is a top perspective view of the FIG. 1 mattress with a figurative person secured in place.

Referring now to both FIGS. 1*a* and 1*b*, a set of shoulder securing straps 102 are configured to secure the person being transported on the mattress by the shoulder region. A first end of each shoulder securing strap 102*a*, 102*b* is attached to a point on the mattress just above the respective shoulder. A second end of each shoulder securing strap 102*a*, 102*b* is attached to a point on the mattress just below the respective shoulder, typically in the armpit region. The shoulder securing straps' length may be adjusted via the adjustable connection until the shoulders are secured in place against the mattress.

A chest securing strap 104 traverses the person's chest region while simultaneously securing both the person's arms and body. As seen in the figures, the ends of the chest securing strap 104 may be attached to the mattress at two points, one on each side of the person's torso. Like the shoulder securing straps 102*a*, 102*b*, the chest securing strap's length may be adjusted via the adjustable connection until the chest is secured in place.

Similarly, a hip securing strap 106 may traverse the person's hip region, securing the person's hip area. As seen in the figures, the ends of the hip securing strap 106 may be attached to the mattress at two points, one on each side of the person's hips. Like the chest securing strap 104, the hip securing strap's length may be adjusted via the adjustable connection until the hips are secured in place. A final securing strap, the groin securing strap 108, secures the lower region of the body and, along with the shoulder securing straps 102*a*, 102*b*, prevents the patient from sliding vertically. A first end of the groin securing strap 108 may be attached to the mattress between the legs, in the groin region, while a second end of the groin securing strap 108 may be attached to the hip securing strap 106 (e.g., via a three-way side release buckle, as seen in the diagrams). A three-way side release buckle would allow for a single buckle to quickly secure both the patient's hip securing strap 106 and groin securing strap 108; however, it is entirely possible to use buckles that allow the hip securing strap 106 to be secured independently of the groin securing strap 108.

In certain embodiments, a feet securing strap 116 may traverse the person's calf or foot region to further secure the person and prevent any shifting of the legs. As seen in the figures, the ends of the leg securing strap 116 may be attached to the mattress at two points, one on each side of the person's lower leg region. Like the other securing straps, the leg securing strap's length may also be adjusted via the adjustable connection until the legs are secured in place. The mattress 100 may also include one or more strap ties 118. The strap ties 118 are typically mounted on the mattress's surface and are used to secure one or more straps in the folded position while not in use. Strap ties 118 are particularly useful during storage and/or deployment of the mattress because the strap ties 118 keep the straps stowed in an orderly compact fashion and prevent tangling. Each strap tie 118 may be constructed from hook-and-loop fasteners (e.g., VELCRO™) or another reusable securing tie or strap.

Although the depicted embodiment illustrates the various securing straps as parallel or perpendicular to the person's body, as seen in FIG. 1*b*, it should be appreciated that the straps may be installed diagonally and/or crossways. For example, the chest securing strap 104 and hip securing strap 106 may be installed, or connected, such that the straps form an 'X' over the person's stomach region. In fact, if side release buckles are used, a single construction may be used where both a parallel and a diagonal configuration may be possible, depending on how the medical response person chooses to secure the patient. Similarly, the shoulder straps may also be installed, or connected, such that the straps form an 'X' over the person's shoulder/upper body region.

The mattress 100 may also have a number of side-handles 110*a*, 110*b*, 110*c*, 110*d* positioned on each side of the mattress for use when carrying the mattress/person. Although 4handles are used in the figures (2 on each side), a person of skill in the art would appreciate that greater or fewer handles may be installed depending on the size of the handles and the size of the mattress/patient. For example, when a larger person is being transported, additional handles may be preferred so that each medical response person can carry a single handle, therefore better distributing the weight. This is particularly helpful when a patient (large or small) is being loaded into an ambulance, a task which often requires the paramedics to lift the patient 3 to 4 feet off the ground.

For added durability, side-handles 110*a*, 110*b*, 110*c*, 110*d* may be anchored or sewn into the various layers of the mattress, including a bottom ballistic nylon layer (to be discussed below). In certain embodiments, a handle 110A, 110B and an opposing handle 110C, 110D may be constructed from a single continuous piece of strap material which travels the width of the mattress and provides additional durability by supporting the patient from underneath. In yet another embodiment, the side-handles 110*a*, 110*b*, 110*c*, 110*d* may be attached to one or more spinal boards.

When the mattress is supported by the side-handles 110*a*, 110*b*, 110*c*, 110*d* from a single point, the spinal boards 300 provide rigidity to the patient's back while the sides come up somewhat to form a side-wall or safety cocoon. Depending on the condition of the patient, it may be necessary to airlift the patient to the nearest hospital. In this situation, the side-handles may be connected to a helicopter winch or harness and the mattress lifted to safety without harming the patient.

Preferably, installed at each end of the mattress are transport straps 112, 114. In a preferred embodiment the transport straps at the head end A would be used to pull, or tow, the patient while the transport straps at the foot end B could be used to guide the patient. However, both the transport straps at the head end A and the transport straps at the foot end B are equally capable of being used to pull and/or to guide the patient during transit. Depending on the design, additional or fewer transport straps may be installed at each end. For example, the strap 112 may comprise a single strap for a one-person pull; the single strap may, however, have side handles sewn therein at forward portions thereof to allow for a two-person pull with the single strap. Alternatively, two straps 112 may have means (such as Velcro™, buckles, etc.) to couple them together to provide, in effect, a single strap. For added durability, the transport straps 112, 114 may be anchored or sewn into the various mattress panels, including the ballistic nylon. In certain embodiments, the head end A transport straps 112 and foot end B transport straps 114 may be constructed from a single continuous piece of strap material which travels the length of the mattress and provides additional durability. In yet another embodiment, the head end A transport straps 112 and/or foot end B transport straps 114 may be attached to one or more spinal boards, further increasing durability and stability.

In certain embodiments, the head and foot wrappings of a conventional Supersled® or Evacusled® Evacu-slide mattresses may also be incorporated to provide additional protection to the person being transported. See, for example, U.S. Pat. No. 7,774,877, U.S. Patent Publication No. 2010/0251479A1, U.S. patent Ser. No. 12/862,253 and U.S. patent Ser. No. 12/700,027, all to Christopher Kenalty, which are assigned to the assignee of the present application, and each of which is incorporated herein by reference. Each application teaches an evacuation mattress, evacuation sled, and/or smart mattress. For example, the '877 patent to Kenalty discloses an Evacusled, an emergency evacuation mattress for bed-ridden patients that is capable of operation by a single caregiver, provides a warm and secure cocoon for a patient, allows easy transport over any type of surface, provides proper support for all of a patient's body and bedding, and allows a patient to feel a high degree of comfort in what is otherwise a very stressful situation. These beneficial features, including smart mattress functionality and supplemental bedding/covering, may be incorporated with the mattress. As one example only, the upper sheets of the Evacusled™ which wrap over the patient (except for a head-hole) may be used with the present embodiment to provide an even more secure patient evacuation environment.

Figure 2:
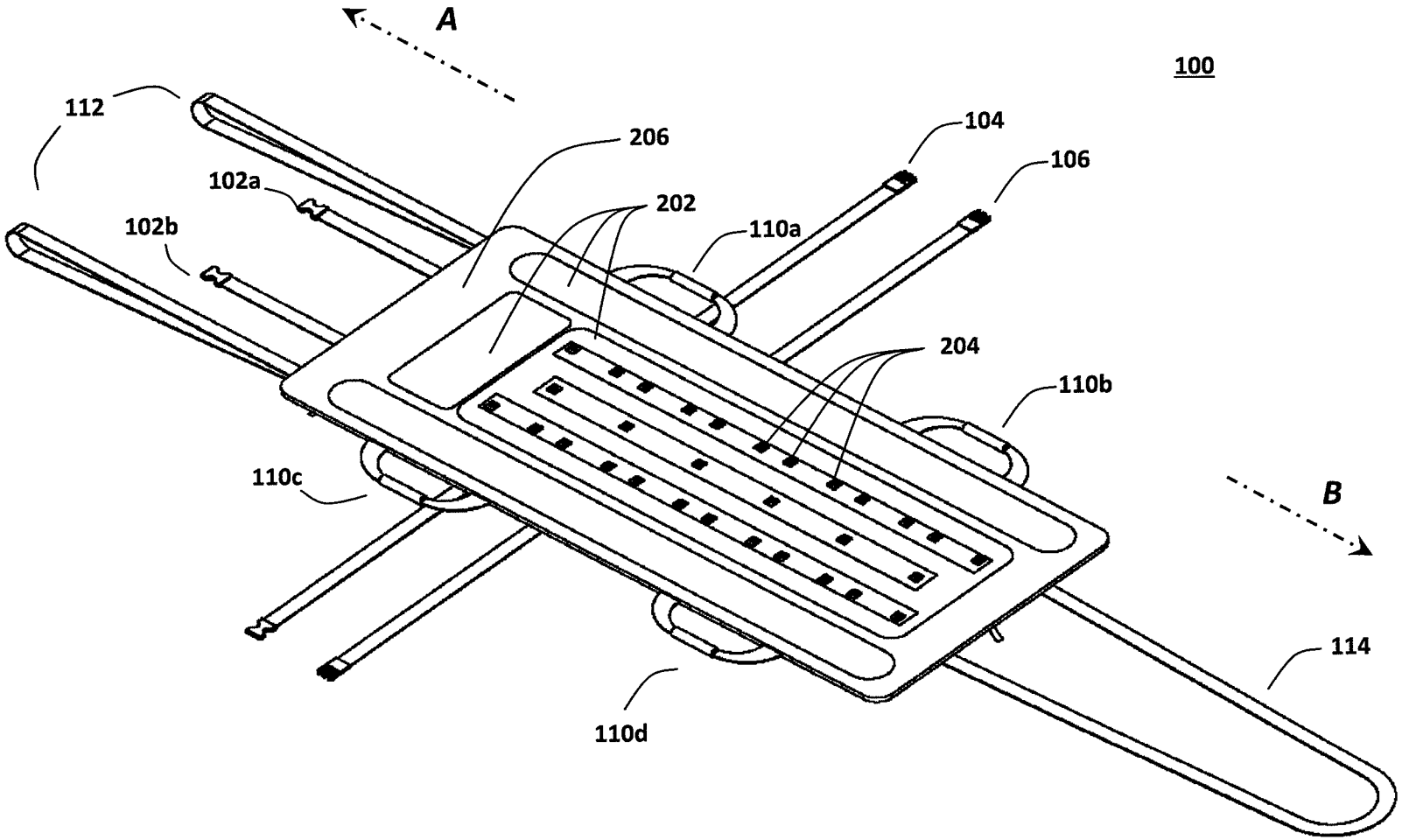
FIG. 2 is a perspective view of the underside of the FIG. 1 mattress.

FIG. 2 is a perspective view of the underside of the presently preferred mattress. The underside 206 of the mattress preferably includes a number of casters 204, or wheels, which reduce the friction when being dragged. The casters 204 are ideally a plastic material, and, as shown in FIG. 3, mounted on the spinal boards 300 (e.g., five spinal boards, with five wheels in each board, two on each outer portion and one in a middle portion) embedded within the mattress. To reduce wear and tear on the outer lower skin panel 206, a second material 202 having a durability greater than the lower skin panel 206 may be sewn and/or bonded to (e.g., welded, glued, heat-fused, and/or epoxied) to the lower panel of the outer skin 206. Presently preferred is to sew four different panels to the bottom skin 206: two side-edge panels, a head-reinforcing panel, and a central torso panel. Alternatively, the entire lower skin panel 206 may be made from the second material 202 having a durability greater than the upper skin panel 120 and/or lower skin panel 206. Suitable second materials 202 having a durability greater than the upper skin panel 120 and/or lower skin panel 206 may include, for example, Kevlar, which has an excellent co-efficient-of-friction factor, or ballistic nylon, which is a thick, tough nylon fabric. Forming the entire lower skin panel 206 from a single high-durability material 202, although typically more expensive than regular skin material (e.g., less-durable skins such as Ultra 53-14), would eliminate the need to cut and bond a second material to the lower skin panel 206 thereby reducing labor and some material costs.

Figure 3A:
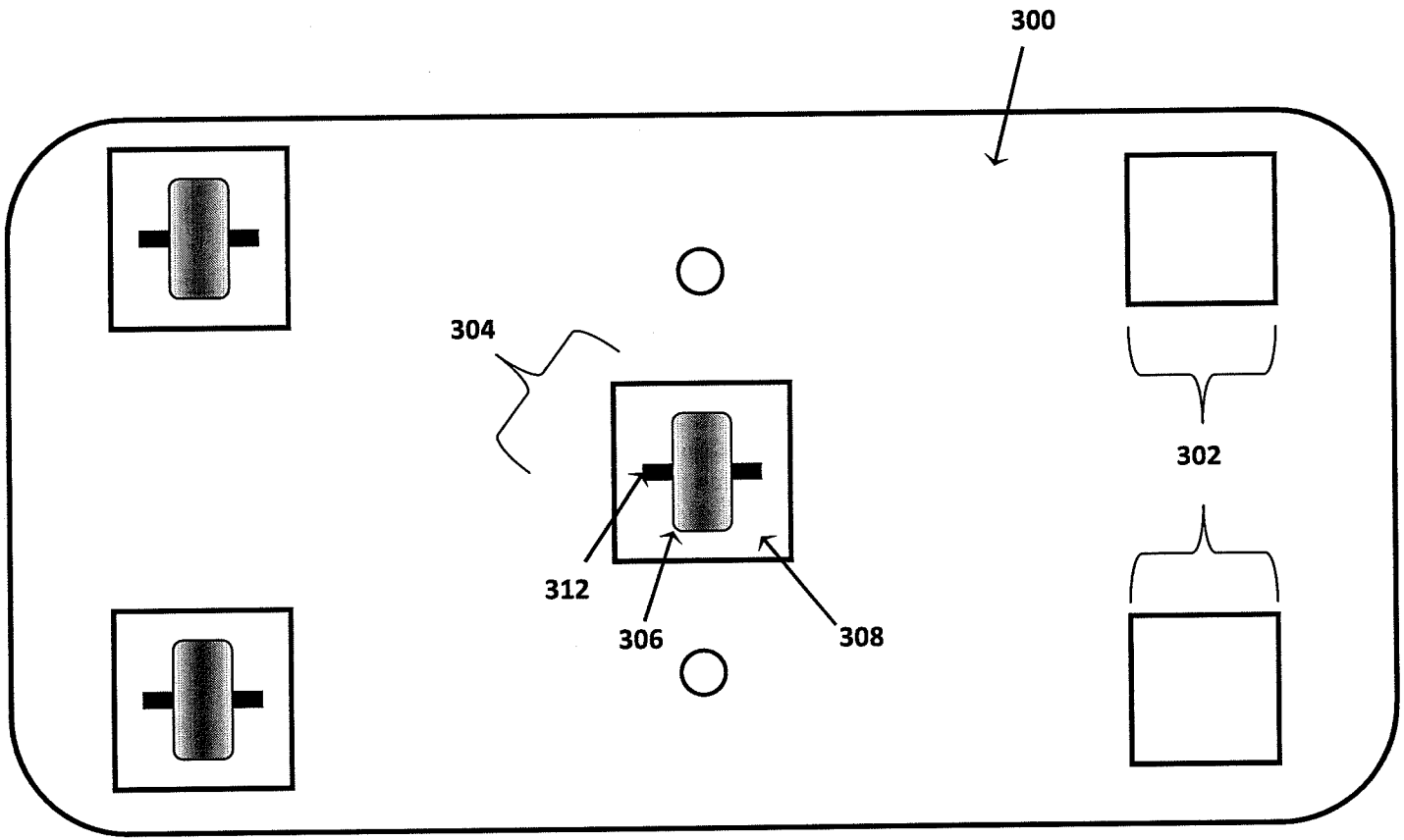
FIG. 3*a* is a bottom plan view of a spinal board for use with the FIG. 1 mattress.
Figure 3B:
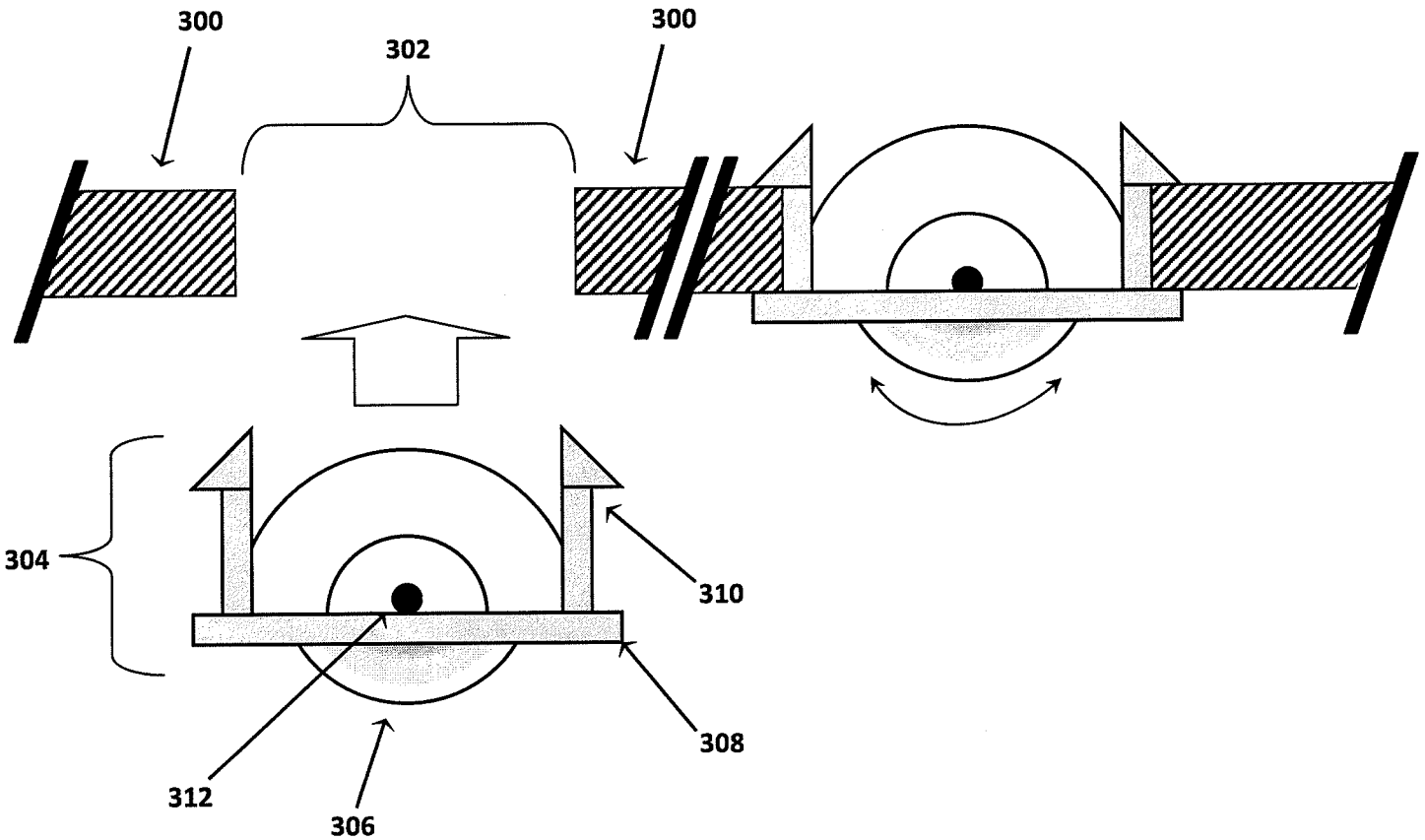
FIG. 3*b* is a side cutaway view of a spinal board and casters for use with the FIG. 1 mattress.

FIG. 3*a* is a bottom plan view of a spinal board 300 for use with the mattress. The main role of the spinal board 300 is to provide additional support in the back and spinal regions. This support is particularly important when transporting an injured person (e.g., when lowering from a window or moving up or down a flight of stairs), because not only will the person will require additional back support, but the emergency worker will require that the mattress stay somewhat planar when the person is being transported. As seen in FIG. 4, the spinal boards provide a much needed rigidity transverse to the longitudinal axis while the patient would provide needed rigidity to the longitudinal axis. Presently, five rectangular spinal boards are preferred, but other numbers and/or sizes may be adapted for different patient types and evacuation circumstances.

Referring back to FIG. 3*a*, a spinal board 300 is typically constructed from a plastic material (e.g., polystyrene, PVC, nylon, or other polymers, including high-performance polymers) and has dimensions approximately 0.5×7.5×15.75 inches. While a 15.75 inch board is sufficient for a majority of the population, in bariatric cases, the width may need to be increased to accommodate a larger body type. Alternatively, spinal boards 300 may be placed side by side to increase the overall width.

Each spinal board 300 may include a plurality (e.g., 5 or 6) of square openings 302, each approximately 1 inch×1 inch, where each is capable of receiving a caster 304 or other wheel structure. Referring now to the cutaway diagram in FIG. 3*b*, a caster 304 may be snapped or clipped into each square opening 302. Using casters 304 that may be snapped into the spinal board 300, as opposed to those that are permanently attached or integrated, allows for easy replacement should a caster break or otherwise malfunction. This configuration also allows for interchanging the casters (e.g., with larger casters) for different surfaces. Each caster 304 may generally comprise a single cylindrically-shaped wheel 306 mounted within a housing 308, typically with an axle 312 (although other variations are possible). The housing 308 is configured to fit snugly within the square opening 302 and include side pressure clips 310 which snap the caster 304 in place once in the spinal board 300. However, it should be appreciated that the mattress is not limited to this type of caster. If the mattress is used in a snowy/icy region, for example, it may be advantageous to omit casters or to use skid plates. In a preferred embodiment, materials used to fabricate the spinal board 300 or caster 304 should be radiolucent (e.g., made of a material that will not interfere with X-ray diagnosis) a feature that, because of its versatility and ease of use, will be well-received in the critical care bed market. This is important because the mattress may stay with the patient even during X-ray procedures, particularly if the patient is in a delicate state and should not be moved until X-rays are complete. Suitable materials would include, for example, various plastics, polystyrene, PVC, nylon, or other polymers, including high-performance polymers.

Figure 4A:
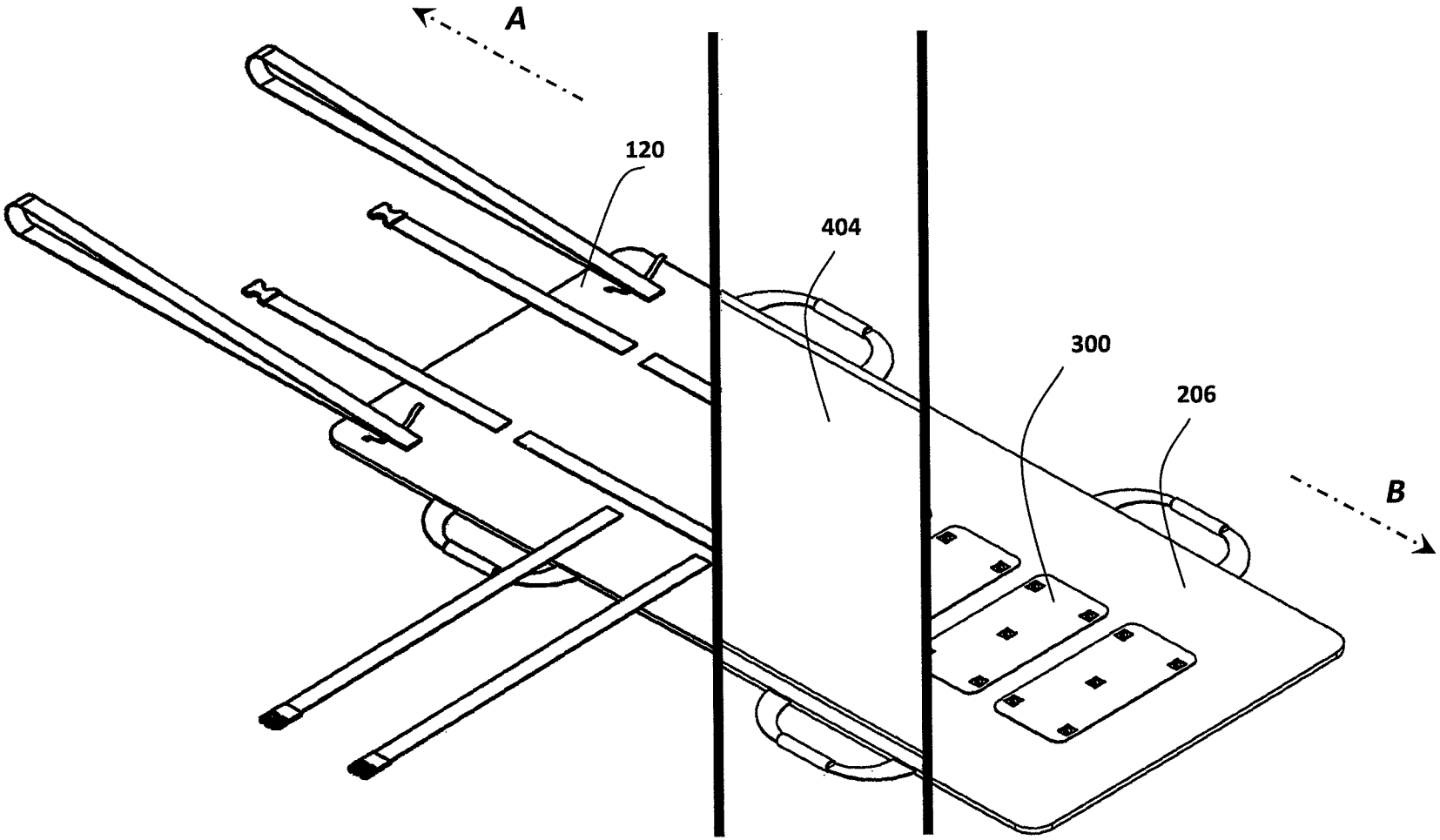
FIG. 4*a* is a perspective view of the FIG. 1 mattress with the various layers removed to reveal inner structure.

FIG. 4*a* is a top perspective view of a mattress with both the upper skin panel 120 and padding layer 404 partially removed (in the left-to-right panels in the figure) to reveal the inner surface of the lower skin panel 206 and spinal boards 300.

Figure 4B:
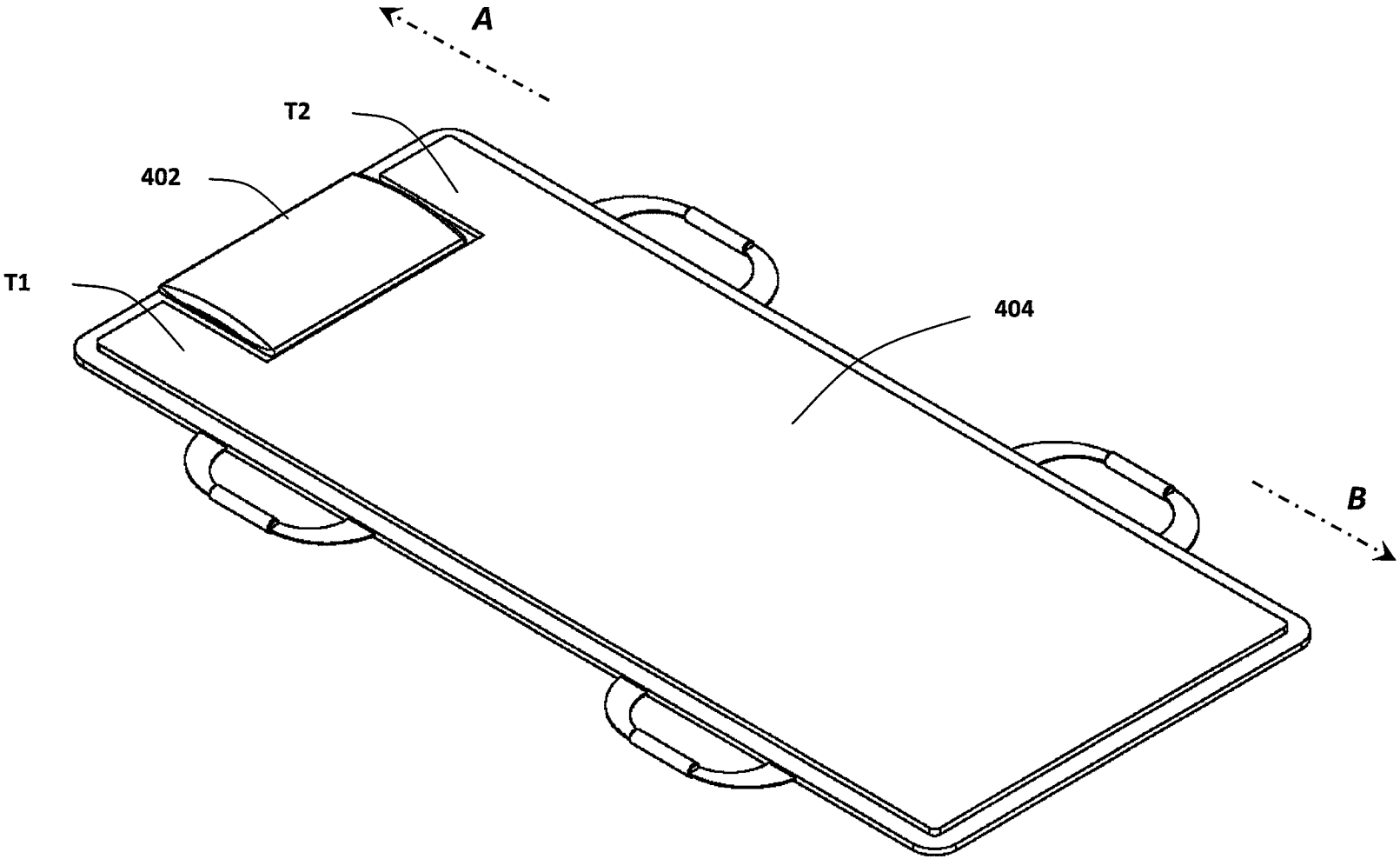
FIG. 4*b* is a perspective view of the FIG. 1 mattress with the upper skin panel completely removed to reveal the interior construction with a padding layer over the spinal boards.

FIG. 4*b* is a top perspective view of a mattress with the upper skin panel 120 completely removed to reveal the interior construction and padding layer 404. A padding layer 404 (e.g., a fire retardant foam layer) is installed over the spinal boards 300 to provide protection and comfort to the patent. The padding layer 404 extends from the foot end B to the head end A where the padding layer installed on each side of the pillow 402 is approximately ½ to 1 inch thicker to prevent the head from shaking or shifting during transit. In certain situations (e.g., those involving neck or head injury), a head immobilizing strap may also be installed at the head end to further prevent head movement. In certain embodiments, the pad may be substantially thicker (e.g., 3 inches or more) and buoyant, allowing the mattress to be used as a flotation device in flooded situations. Preferably, the padding is made of polyester or like material, which retains heat even when wet. However, any known and convenient material (or combination of materials) may be used, depending on use.

Typically, the padding layer 404 is about ½ to 1 inches thick in the body region so that it is comfortable and warmth-retaining like a mattress, while being thicker at the head end A (e.g., ½ to 1 inches) on each side of the pillow 402, near points T1 and T2. By limiting the thickness of the padding layer 404, the mattress is thin enough so that it may fold or roll up into a relatively small package and be stored in a bag or case. A minimal storage size is important because both subways and high-rises have limited space to store such evacuation equipment, especially when installed in or under stairwells.

Figure 4C:
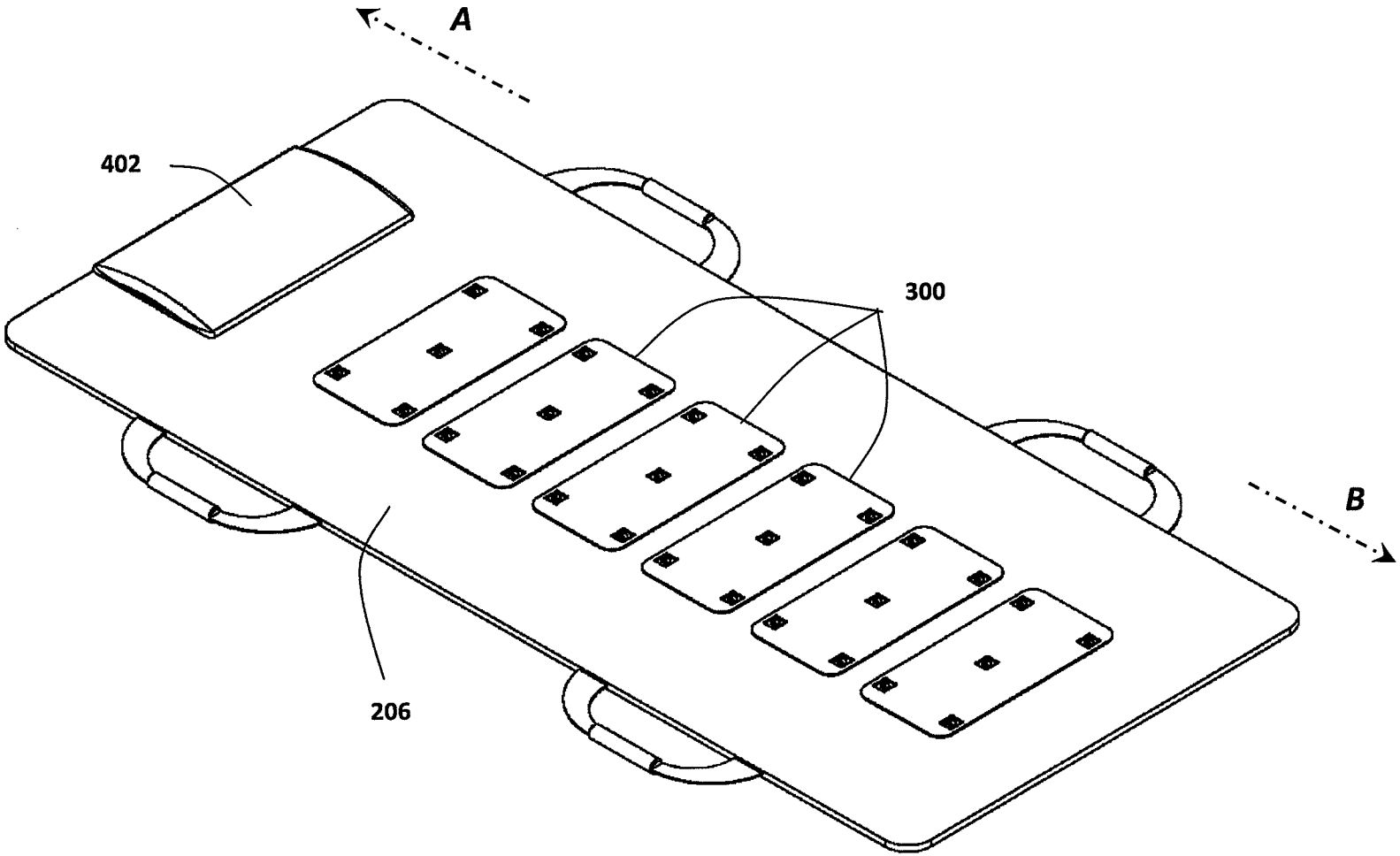
FIG. 4*c* is a top plan view of the FIG. 1 mattress with both the upper skin panel and padding layer completely removed to reveal the interior construction with spinal boards.

FIG. 4*c* is a top perspective view of a mattress with both the upper skin panel 120 and padding layer 404 completely removed to reveal the interior construction with lower skin panel 206 and spinal boards 300. A typical 80-inch mattress will have approximately 5 to 6 spinal boards 300 along the center line. The number of spinal boards 300 may vary depending on the length of the mattress and size of the spinal boards 300. The spinal boards are preferably bonded and/or sewn to the inside surface of bottom skin, with the wheels projecting through corresponding holes in the bottom skin. A pillow 402 is also installed at the head end A to increase head support and comfort. Preferably, the pillow is 1.5-2 inches thick to support the head. As is clear from FIG. 4*c*, there is no spinal board 300 beneath the pillow 402, where the patient's head is supported. To accommodate folding and/or rolling of the mattress, starting at the foot end B, the spacing between the spinal boards 300 preferably increases closer to the head end A. The spinal boards 300 may be attached to the lower skin panel 206 using a number of methods, including, for example, adhesive, riveting and/or stitching.

Figure 5:
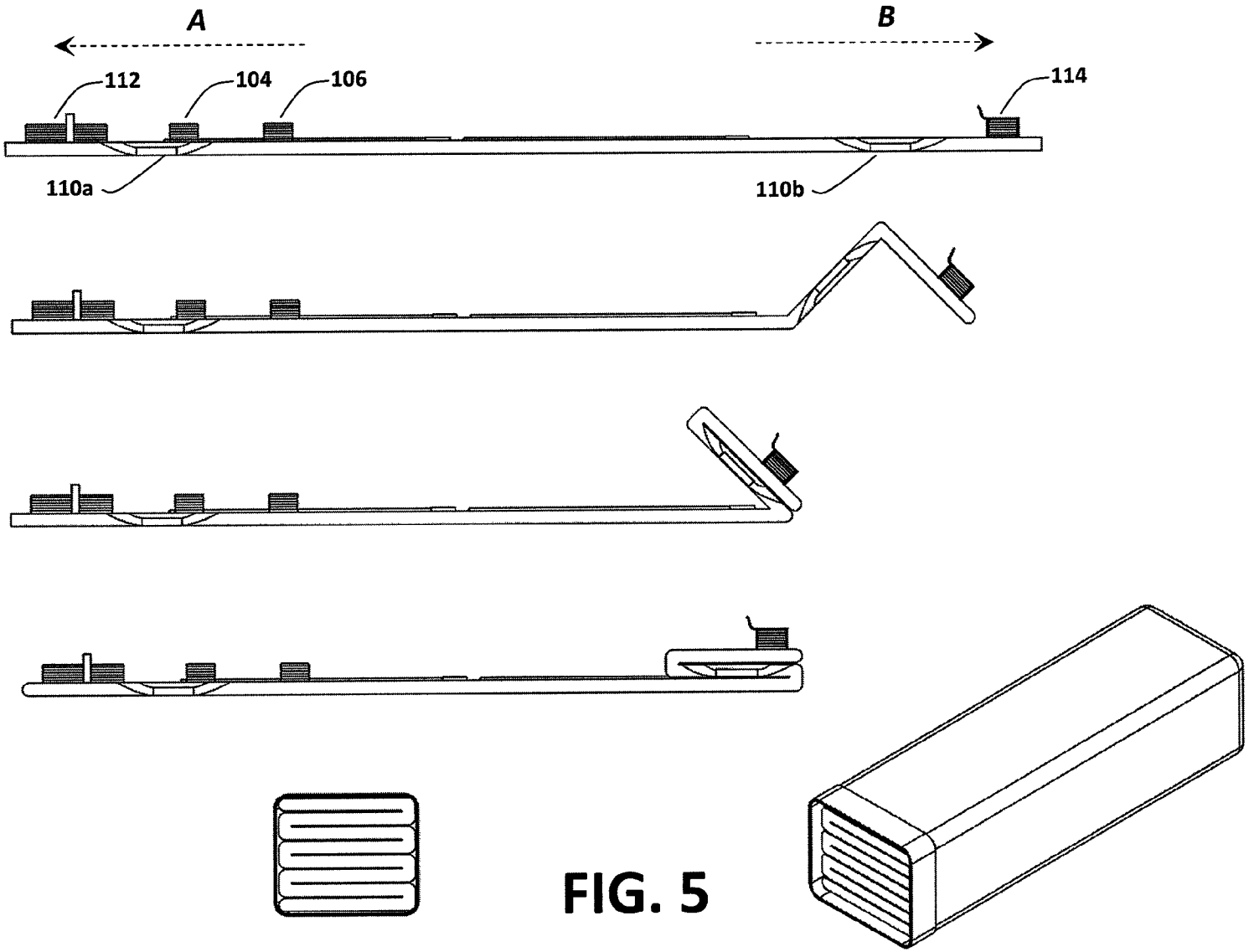
FIG. 5 is a diagram of the FIG. 1 mattress being folded.

FIG. 5 is a diagram of the mattress (i) in the process of being folded for storage and/or transport, (ii) in the final folded position, and (iii) in an example storage case 403. To conserve space, a mattress is capable of being folded or rolled. Typically, the mattress is end-over-end-folded or rolled starting at the foot end B where each mattress bend occurs between adjacent spinal boards 300 (which, as seen in FIG. 4*a*, are embedded in the mattress). As the user folds or rolls the mattress, the spacing between the spinal boards 300 may increase in order to accommodate the greater thickness of the folded portion. This is particularly helpful when the user chooses to roll the mattress, similarly to a sleeping bag. Alternatively, the mattress may be folded like an accordion. Regardless, once folded or rolled, the embedded spinal boards 300 are preferably substantially parallel to one another to minimize volume. In certain embodiments, to prevent unfolding or unrolling, the folded mattress may further include securing straps, hooks and loops (e.g., VELCRO®), and/or another securing means.

The fully folded mattress may be stored in a storage bag or case 403. The storage bag or case may include, for example, a traditional drawstring bag or other closable bag (e.g., with hooks and loops, magnets, zippers, snaps, etc). In situations where storage space is extremely limited, the storage bag may also be vacuum-compressed and sealed. By storing the rolled or folded mattress in an airtight bag and removing the air, the mattress may be reduced to about one-third its original volume, while being protected against insects, dust, mildew and odors, as well as being airtight and watertight. When the mattress is deployed, puncturing the vacuum bag would result in the mattress returning to its original intended size and shape, simply requiring the user to unroll or unfold the mattress.

Figure 6:
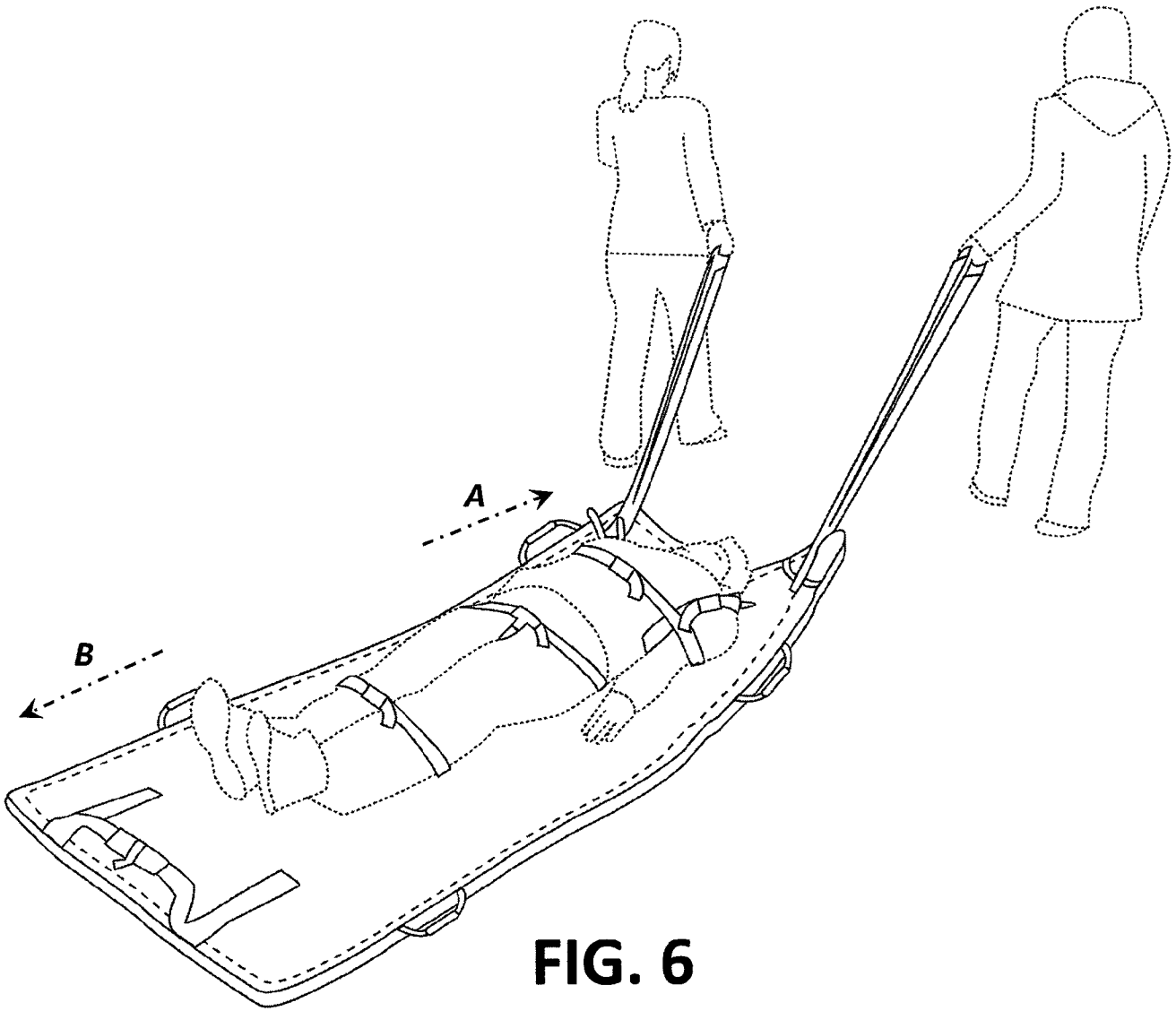
FIG. 6 is a diagram of the FIG. 1 mattress in operation on a level surface.

FIG. 6 is a diagram showing the mattress in use on a level surface. When two paramedics are available, each is able to pull a strap to ease the overall burden. The patient may be then dragged over various surfaces and, if necessary, up or down a flight of stairs.

Figure 7:
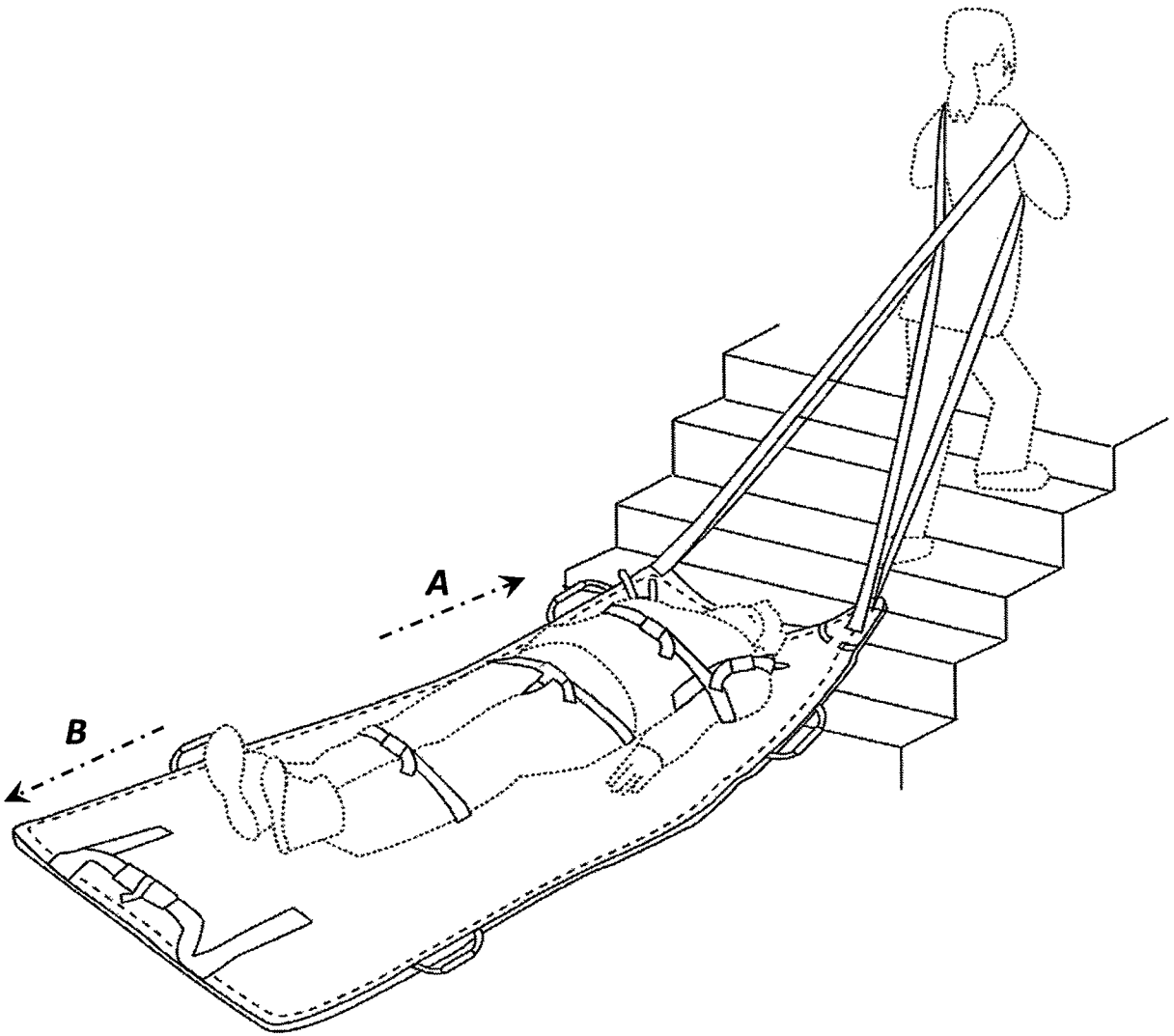
FIG. 7 is a diagram of the FIG. 1 mattress on a staircase.

FIG. 7 is a diagram of the mattress being pulled up a staircase. When only one paramedic is available, the head end A transport straps can act as a haversack harness (e.g., like that used on an ox), therefore freeing use of both arms and eliminating any need to turn around when towing. Rather than the paramedic twisting his or her body, he or she distributes the weight across his or her shoulders to pull the harness, giving the paramedic the ability to pull much greater weight. The process for transporting a person down is very similar, however, rather than pulling the mattress up the stairs, the paramedic instead lowers the mattress by the head end A transport straps until the mattress has reached the next level. If available, a second person may steer the mattress while it is lowered down the stairs (or while it is pulled up the stairs) by the foot end A transport straps. Although it is entirely possible to lower or pull a person by the foot end, this could lead to neck and/or head injury in the event the paramedic inadvertently releases the strap or the strap malfunctions.

The mattress may also use a triage tag, which is particularly useful in emergency situations. Triage tags are tools that are often used for first responder and medical personnel use during a mass casualty incident. With the aid of the triage tags, the first-arriving personnel are able to effectively and efficiently distribute the limited resources and provide the necessary immediate care for the victims until more help arrives. Simple Triage and Rapid Treatment ("START") is a strategy that the first responders and medical personnel employ to evaluate the severity of injury of each victim as quickly as possible and to tag a victim in about 30-60 seconds. The triage tags are normally placed near the head and are used to separate the victims so that when more help arrives, the extra help is able to ascertain the most dire cases by the easily recognizable triage tags. For the purpose of the mattress according to the preferred embodiments, the triage tags may be placed on the foot end B of the mattress, so once the mattress is deployed, the triage tag is clearly visible. In a most-preferred embodiment, a first triage tag is permanently or temporarily affixed to the bottom-left corner of the mattress, and a second triage tag is similarly affixed at the top right corner of the mattress. The triage tag may have a folding design allowing effective, quick, and simple triage, but more importantly the folding tag allows patients to be re-triaged without having to replace the tag. This is in line with States that have standardized triage tags. Presently, the U.S. states and cities that use a standardized or Dynamic Triage Tag include New York State, Connecticut, Indiana, Illinois, North Carolina, Nevada, Philadelphia, and Boston. The basic sections of a triage tag include four colors of triage, including Black (Expectant) which entails pain medication only until death; Red (Immediate) which entails life-threatening injuries; Yellow (Delayed) which entails non-life-threatening injuries; and Green (Minor) which entails minor injuries.

The triage tag may also include a section informing medical personnel of the patient's vital signs along with the treatment administered, a section on the patient's demographics (i.e., gender, residential address, etc. and the patient's medical history), and/or a section with a full pictorial view of the human body where the medical personnel may indicate which parts of the body are injured.

The individual components shown in outline or designated by blocks in the attached drawings are all well-known in the mattress and medical equipment arts, and their specific construction and operation are not critical to the operation or best mode for carrying out the invention.

While the present invention has been described with respect to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

All U.S. and foreign patent documents, all articles, all brochures, and all other published documents discussed above are hereby incorporated by reference into the Detailed Description of the Preferred Embodiment.

What is claimed is:

1. An evacuation mattress comprising:

at least one outer skin panel having head end and a foot end;

a plurality of spinal boards coupled to the at least one outer skin panel, the plurality of spinal boards being disposed beneath an area of the at least one outer skin panel configured to support a waist of an evacuee but not the head of the evacuee, the plurality of spinal boards being disposed more toward one end of the at least one outer skin panel than the other end; each spine support board having at least five wheel devices extending through corresponding holes in the outer skin panel; wherein each of the at least five wheel devices comprises: a clip structure configured to be clipped into a corresponding opening in the corresponding spinal board; a plate coupled to said clip structure; an axle extending in a direction substantially parallel to a longitudinal direction of the corresponding spinal board and disposed above said plate; and a wheel rotating about said axle and disposed such that the wheel extends less than halfway through a corresponding hole in the outer skin panel;

at least two adjustable patient-securing straps coupled to the at least one outer skin panel;

a padding layer disposed between the at least one outer skin panel and the plurality of spinal boards; and at least one transport strap coupled to the at least one outer skin panel.

2. The mattress of claim 1, further comprising at least four wheel devices mounted on each spinal board.

3. The mattress of claim 1, further comprising at least two side-handles respectively coupled to opposite sides of the at least one skin panel.

4. The mattress of claim 1, wherein the at least one outer skin panel includes at least an upper skin panel and a lower skin panel.

5. The mattress of claim 4, wherein the lower skin panel further includes a second material, having a durability greater than the lower skin panel, attached to the lower skin panel.

6. The mattress of claim 4, wherein the lower skin panel is constructed from a second material having a durability greater than the upper skin panel.

7. An evacuation mattress comprising:

an upper skin panel;

a lower skin panel having an upper surface and a lower surface, a second material with a durability greater than the lower skin panel being attached to the lower surface;

a plurality of spinal boards attached to the upper surface of the lower skin panel, each spinal board having at least five wheel devices extending through corresponding holes in the lower skin panel, each spinal board having one wheel device coupled to each corner of the spinal board and one wheel device coupled to a center of the spinal board wherein longitudinal spacing between adjacent spine support boards is such that the mattress may be accordion-folded in a longitudinal direction;

wherein each of the at least five wheel devices comprises: a clip structure configured to be clipped into a corresponding opening in the corresponding spinal board; a plate coupled to said clip structure; an axle extending in a direction substantially parallel to a longitudinal direction of the corresponding spinal board and disposed above said plate; and a wheel rotating about said axle and disposed such that the wheel extends less than halfway through a corresponding hole in the outer skin panel;

a thermal-padding layer located between the plurality of spinal boards and the upper skin panel;

at least one adjustable shoulder strap coupled to the upper skin panel;

at least one adjustable chest strap coupled to the upper skin panel; and at least one adjustable hip strap coupled to the upper skin panel, and having an adjustable groin strap coupleable thereto.

8. The evacuation mattress of claim 7, further comprising four side handles coupled to the lower skin panel.

9. The evacuation mattress of claim 7, further comprising a second material having a durability greater than the lower skin panel to which it is attached.

10. An evacuation mattress, comprising;

a flexible anti-fungal top sheet having a head end and a foot end;

a flexible anti-fungal bottom sheet coupled to or integral with the top sheet, the bottom sheet having an internal surface and an external surface;

at least one towing strap coupled to a head end of the top sheet;

a chest strap coupled to the top sheet;

a hip strap coupled to the top sheet;

a plurality of rigid spinal boards coupled to the internal surface of the bottom sheet, the plurality of spinal boards being disposed beneath an area of the bottom sheet configured to support a waist of an evacuee but not the head, each spinal board having at least five wheel devices extending through corresponding holes in the bottom sheet, each spinal board having one wheel device coupled to each corner of the spinal board and one wheel device coupled to a center of the spinal board;

wherein each of the at least five wheel devices comprises: a clip structure configured to be clipped into a corresponding opening in the corresponding spinal board; a plate coupled to said clip structure; and axle extending in a direction substantially parallel to a longitudinal direction of the corresponding spinal board and disposed above said plate; and a wheel rotating about said axle and disposed such that the wheel extends less than halfway through a corresponding hole in the outer skin panel; the plurality of spine support boards being (i) disposed beneath the spine of the evacuee but not beneath the head of the evacuee, and (ii) disposed more toward a foot end of the mattress that a head end thereof;

a padding layer disposed between the spinal boards and the top sheet; and a pillow layer disposed below the head end of the top sheet.

11. The evacuation mattress of claim 10, further comprising four side handles coupled to the bottom sheet.

12. The evacuation mattress of claim 10, further comprising a second material having a durability greater than the bottom sheet to which it is attached.

* * * * *